US005461878A

United States Patent [19]

Moore et al.

[11] Patent Number: 5,461,878

[45] Date of Patent: Oct. 31, 1995

[54] HEAT TRANSFER DEVICE AND METHOD

[75] Inventors: Earl H. Moore, Blanchard; Thomas J. Frick, Rosebush; Wayne W. Smith, Mt. Pleasant, all of Mich.

[73] Assignee: The Delfield Company, Mount Pleasant, Mich.

[21] Appl. No.: 189,893

[22] Filed: Feb. 1, 1994

Related U.S. Application Data

[63] Continuation-in-part of Ser. No. 872,813, Apr. 24, 1992, Pat. No. 5,282,367.

[51] Int. Cl.[6] ..... A47F 3/04

[52] U.S. Cl. ..... 62/255; 62/256; 62/414; 165/139

[58] Field of Search ..... 62/255, 256, 413, 62/414; 165/55, 139

[56] References Cited

U.S. PATENT DOCUMENTS

| | | | |
|---|---|---|---|
| 2,810,267 | 10/1967 | Reuter et al. | 62/256 |
| 3,020,733 | 2/1962 | Hubacker et al. | 62/414 |
| 3,212,285 | 10/1965 | Wilson | 62/414 X |
| 3,501,925 | 3/1970 | Brennan et al. | 62/256 |
| 4,633,677 | 1/1987 | Maehara | 62/256 |
| 4,644,758 | 2/1987 | Maehara et al. | 62/234 |
| 4,685,311 | 8/1987 | Rastelli | 62/258 |
| 4,691,527 | 9/1987 | Ikeda | 62/234 |
| 4,723,414 | 2/1988 | Hurutachi et al. | 62/155 |
| 4,741,171 | 5/1988 | Toshiyuki | 62/234 |
| 5,191,769 | 3/1993 | Mangini et al. | 62/258 |

FOREIGN PATENT DOCUMENTS 3029903 4/1981 Germany .

*Primary Examiner*—William E. Tapolcai
*Attorney, Agent, or Firm*—Harness, Dickey & Pierce

[57] ABSTRACT

A heat transfer device for cooling a fluid has powered means for moving the fluid to create a primary fluid flow, a heat exchanger, and direction controlling surfaces for directing the primary fluid flow toward and through a first portion of the heat exchanger, thereby cooling the fluid flow. The direction controlling surfaces then split the primary fluid flow into a first and second subsidiary fluid flow, and direct the second subsidiary fluid flow through a second portion of the heat exchanger, thereby cooling it to a second temperature which is lower than the first temperature.

16 Claims, 2 Drawing Sheets

Fig. 1.
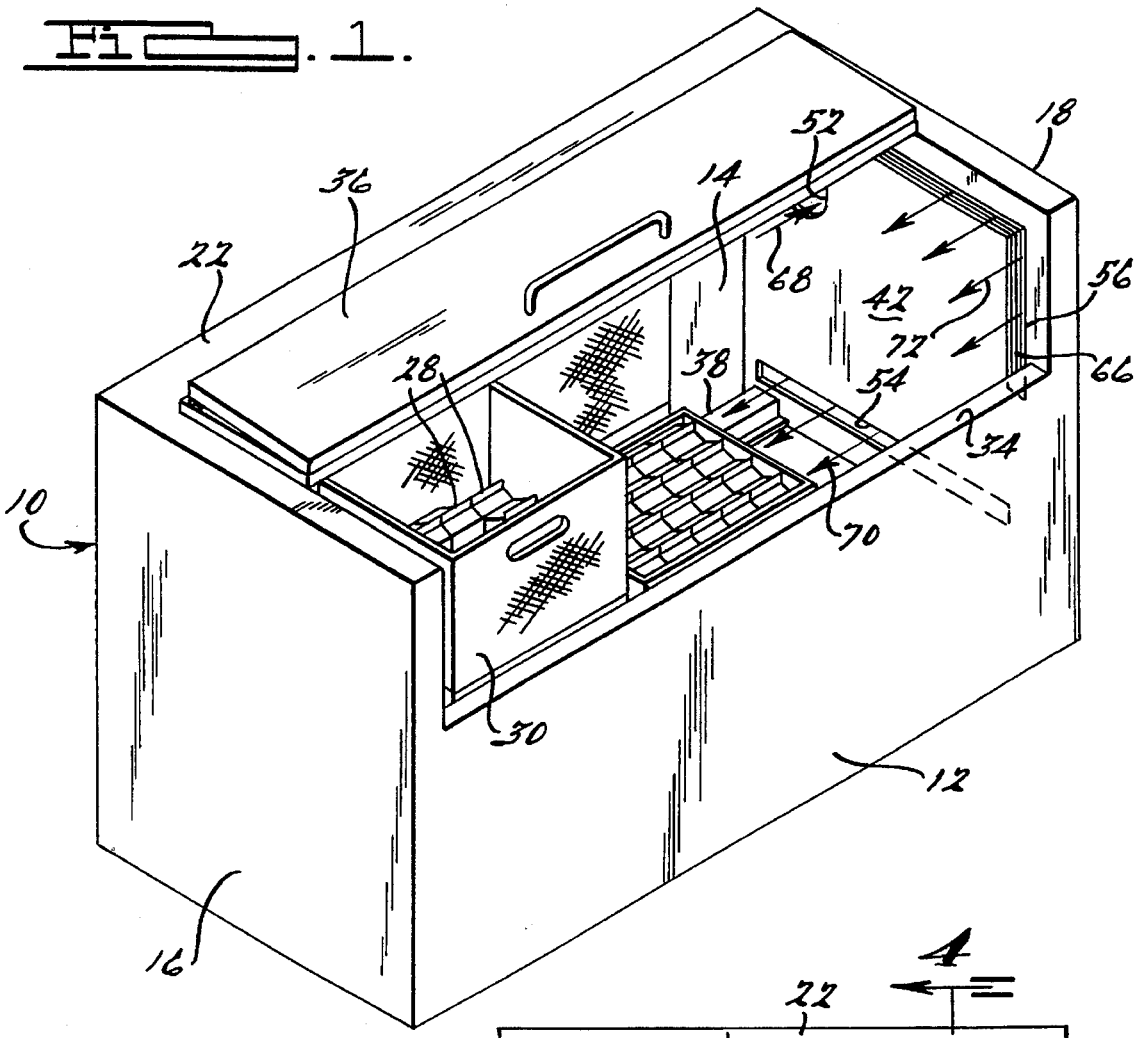
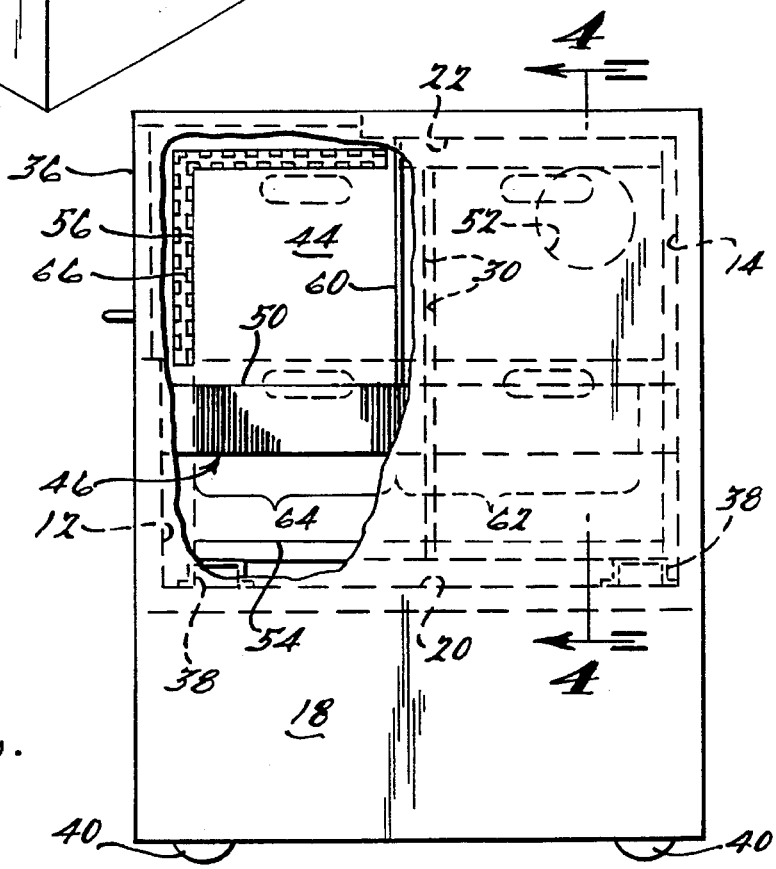
Fig. 2.

HEAT TRANSFER DEVICE AND METHOD

CROSS REFERENCE TO RELATED APPLICATION

This application is a continuation-in-part of U.S. patent application Ser. No. 872,813, filed Apr. 24, 1992, now U.S. Pat. No. 5,282,367.

BACKGROUND AND SUMMARY OF THE INVENTION

This invention relates generally to heat transfer devices, and more particularly to a unique forced convection heat transfer device.

Refrigerated containers and other heat transfer devices are utilized for a wide variety of applications, including household refrigerators, grocery display cabinets, convection heaters, and coolers for storing, preserving, and providing ready access to food items. Such coolers often use forced air convection provided by generating an air flow which passes through a heat exchanger to cool the air flow, and then forcing that air to pass over objects held in the cooler, thus cooling them by convection.

Most refrigerated containers, such as for example a milk cooler for containing a number of milk cartons, are constructed as a thermally insulated cabinet defining a product storage chamber and having an upper access opening, sometimes also having a door for closing the access opening and preventing free heat transfer between the storage chamber and ambient air. However, even those coolers equipped with an access door are often left open for extended periods of time, resulting in free heat transfer by convection between the storage chamber and ambient air, causing enormous energy efficiency losses and warming the product which is in the storage chamber.

It is generally desirable to maintain the entire volume of the container at temperatures equal to or below 40° F., yet also at temperatures above 32° F. to prevent the product from freezing. However, when the access door is open for a long period of time, previous refrigerated containers were generally unable to maintain the temperature of product disposed near the upper access opening below 40° F., without also cooling the products at the bottom of the cooler below 32° F., often causing the food product in the bottom region of the cooler to freeze.

The present invention overcomes this problem by providing a novel apparatus and method for cooling or heating different regions of a container at different heat transfer rates. In the case of a refrigerated container, the lower region of the refrigerated container is cooled by a first fluid flow. The upper region of the container is cooled by a colder curtain of fluid flowing across the access opening, which has been cooled to a lower temperature than the first fluid flow. Of course, the present invention may also be used to heat different areas of a container at different rates.

The heat transfer device of the present invention includes a fan or other powered means for creating a fluid flow, a heat exchanger, and direction controlling surfaces for directing the fluid toward and through a first portion of the heat exchanger, thereby changing the temperature of the fluid. The direction controlling surfaces then direct a portion of the fluid through a second portion of the heat exchanger, thereby causing that portion to undergo a greater temperature change than the remainder of the fluid.

It is therefore an object of the present invention to provide a unique heat transfer device utilizing forced fluid convection through one heat exchanger which changes the temperature of a plurality of fluid flows in different amounts, whereby the aforementioned problems encountered with known systems are overcome.

These and other advantages and features will become apparent from the following description and claims in conjunction with the accompanying drawings.

BRIEF DESCRIPTION OF THE DRAWINGS

FIG. 1 is a perspective view of a refrigerated container embodying the principles of the present invention;

FIG. 2 is a vertical transverse cross-sectional view of a refrigerated container according to the present invention;

DETAILED DESCRIPTION OF THE PREFERRED EMBODIMENTS

Figure 3:
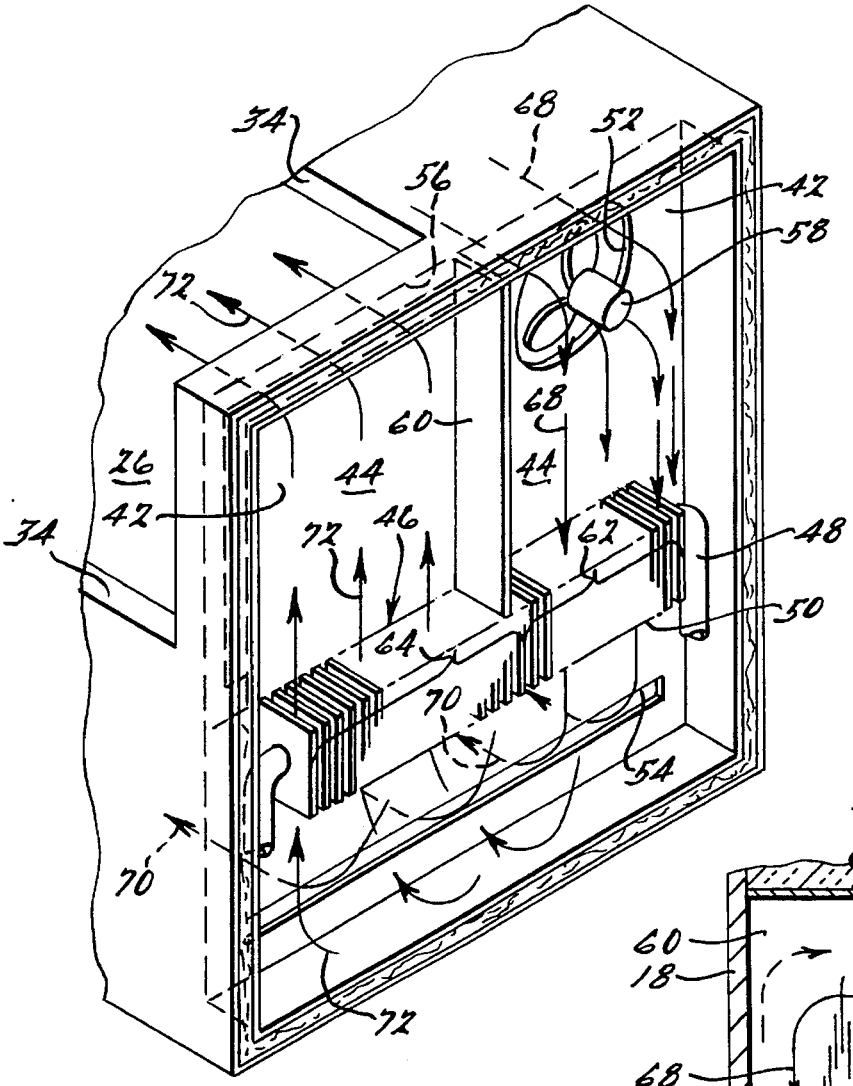
FIG. 3 is a partial perspective cut-away view showing the heat transfer device of the present invention.
Figure 4:
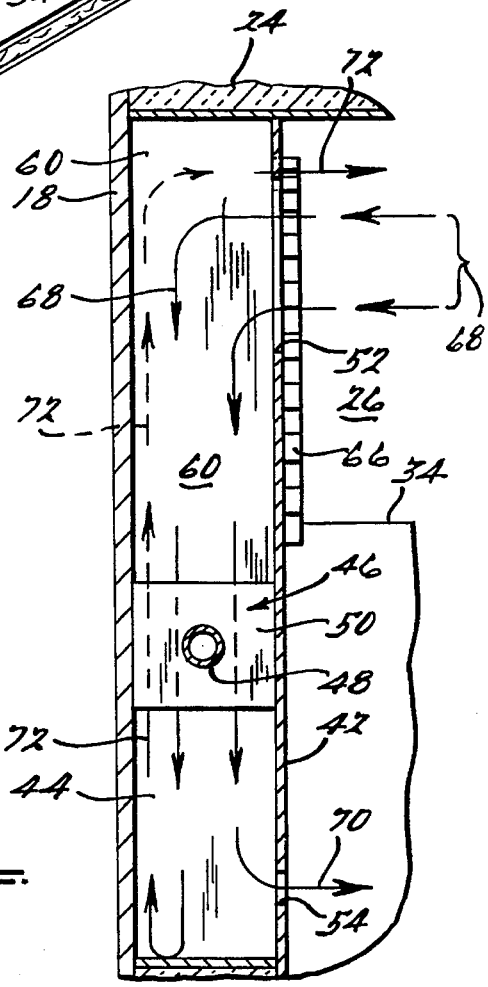
FIG. 4 is a partial vertical cross-sectional view of a refrigerated container according to the present invention taken generally along lines 4—4 in FIG. 2.

With reference to the drawings, FIGS. 1–4 show a refrigerated container constructed generally as a rectangular housing or cabinet 10 having front and rear walls 12 and 14, lateral end walls 16 and 18, a floor 20, and a top wall 22, all of which preferably have thermal insulation 24. Cabinet 10 defines a storage chamber 26 for containing a product 28. In the milk cooler arrangement shown in FIGS. 1 and 2, a number of individual portion milk cartons 30 are stored in crates 32 which may be stacked within the cooler. An access opening 34 is disposed at an upper front region of cabinet 10, equipped with an access door 36 for opening and closing access opening 34. A plurality of floor rails 38 may be provided for supporting product 28 above floor 20 of cabinet 10 to form a gap therebetween. Cabinet 10 may also be provided with wheels 40 for mobility.

When access door 36 is closed, storage chamber 26 is sealed away from ambient air, preventing free convection heat transfer therebetween. However, some embodiments of cabinet 10 of the present invention may not be provided with access door 36, or if so, access door 36 may be left open for extended periods of time.

The present invention provides a novel forced convection heat transfer device for generating and changing the temperature of a fluid. This unique arrangement enables storage chamber 26 and product 28 to be cooled more evenly, and can maintain product 28 within a relatively narrow range of temperature even when access door 36 is open, cooling product 28 below a maximum temperature yet without freezing any portion of product 28. The present invention utilizes a single heat exchanger to change the temperature of different portions of a fluid flow by different amounts. Direction controlling surfaces are also provided to direct a fluid flow through one portion of the heat exchanger to change the temperature thereof, and then to direct a portion of the fluid flow through another portion of the heat exchanger to again change its temperature to a different temperature than a remainder of the fluid flow. The capability of the present invention to generate fluid flows having different temperatures using one heat exchanger relates to the subject matter disclosed in the commonly assigned U.S. Pat. No. 5,282,367, entitled "Refrigerated Food Preparation Table" filed on Apr. 24, 1992, which is hereby incorporated herein by reference.

Accordingly, the present invention provides a partition 42 disposed near end wall 18 of cabinet 10, which defines product storage chamber 26 and a heat transfer chamber 44. A heat exchanger 46 is disposed in heat transfer chamber 44 and is constructed of an evaporator coil 48 and heat transfer fins 50. Heat exchanger 46 is connected to a standard refrigeration circuit (not shown). Heat exchanger 46 extends horizontally across the width of heat transfer chamber 44, intermediate the top and bottom of chamber 44. Partition 42 has a number of openings, forming an inlet 52 and a first and second outlet 54 and 56, each providing fluid communication between product storage chamber 26 and heat transfer chamber 44. First outlet 54 is preferably a wide, narrow vent disposed along floor 20 of cabinet 10, while second outlet 56 extends along a lateral edge of access opening 34. A fan 58 is mounted to partition 42 by mounting hardware (not shown) and is disposed near inlet 52. A baffle 60 is provided in heat transfer chamber 44 and extends from an upper wall of heat transfer chamber 44 vertically down to heat exchanger 46. The intersection between baffle 60 and heat exchanger 46 defines a first and second portion 62 and 64 of heat exchanger 46. A flow vent 66 is preferably mounted in second outlet 56 defining a series of parallel flow passages for encouraging laminar flow from heat transfer chamber 44 across access opening 34. Floor rails 38 elevate crates 30 of product 28 above floor 20 to form a channel between a bottom surface of product and floor 20 of container 10, thereby facilitating passage of air from first outlet 54 along floor 20 of cabinet 10 to cool product 20 in the lower region of the container.

In accordance with the present invention, fan 58 moves air from an upper rear region of storage chamber 26 and generates a primary air flow 68 from storage chamber 26 through inlet 52 formed in partition 42 into heat transfer chamber 44. Primary air flow 68 is directed by baffle 60 and the walls of heat transfer chamber 44 toward and through first portion 62 of heat exchanger 46. Primary fluid flow 68 is thus cooled to a first temperature. After primary fluid flow 68 passes through first portion 62 of heat exchanger 46, it is split into a first and second subsidiary fluid flow 70 and 72. First subsidiary fluid flow 70 is directed by the walls and floor of heat transfer chamber 44 to pass through first outlet 54 and into storage chamber 26. Second subsidiary fluid flow 72 undergoes a flow reversal and is directed by the walls and floor of heat transfer chamber 44 through second portion 64 of heat exchanger 44 so that it is cooled to a second lower temperature. Second subsidiary fluid flow 72 is then directed through second outlet 56 and flow vent 66.

After entering storage chamber 26, first subsidiary fluid flow 70 passes along floor 20 of storage chamber 26 through the channel formed by floor rails 38, thereby cooling the bottom surface of product 28. Flow vent 66 encourages second subsidiary fluid flow 72 to flow straight across access opening 34, to form an air curtain for cooling the upper region of storage chamber 26, and to resist free convection heat transfer between storage chamber 26 and ambient air.

The first or bottom fluid flow 70 is preferably cooled to a temperature above the freezing temperature of product 28, so that product 28 at the lower region of product chamber 26 will not be frozen. Conversely, the second air curtain 72 flowing across the access opening 34 is cooled to a lower second temperature which is preferably below the freezing temperature of the product. This much cooler fluid flow 72 is thus capable of maintaining product 28 in the upper regions near access opening 34 below 40° F., even though access door 36 is open for an extended period of time and no physical barrier extends between the product storage chamber 26 and ambient air.

Baffle 60 operates to maintain primary air flow 68 and second subsidiary air flow 72 separate when they pass through heat transfer chamber 44. The position of baffle 60 along heat exchanger 46 defines an inverse proportional relationship between the respective sizes of first and second portions 62 and 64 of heat exchanger 46, thereby defining an inverse proportional relationship between the respective flow rates of first and second subsidiary fluid flows 70 and 72. Baffle 60 may be placed in a preselected position during manufacture, or may be mounted to allow fore and aft adjustment after the cooler is constructed. In addition, first and second outlet 54 and 56 can be constructed of varying sizes to provide an optimum balance between first and second subsidiary air flows 70 and 72.

In an alternative embodiment of the present invention, a second heat transfer device (not shown), which is similar to the heat transfer device shown, may be provided near the opposite lateral end wall 16 of cabinet 10 to provide more balanced cooling. In addition, inlet 52 may be disposed in the interior end wall 16 of storage chamber 26 opposite heat transfer chamber 44. The inlet air would then be ducted through the rear wall 14 of container to heat transfer chamber 44, to encourage first and second subsidiary air flows 70 and 72 to pass across the entire width of the container.

Although the present invention is illustrated and described herein as a refrigerated container for cooling an air flow, the present invention may also be used to heat or cool other fluids. For example, the present heat transfer device might be used in a warming oven or hot tub for heating different regions of an environment at different rates.

The heat transfer device of the present invention thus provides a novel arrangement for generating fluid flows of different temperatures with a single heat exchanger. The novel method of the present invention for changing the temperature of a fluid flow to a first temperature, then splitting that fluid flow and then further changing the temperature of a portion thereof a greater amount to a second temperature with a single heat exchanger is accomplished by the unique arrangement of heat exchanger, baffle, inlet and first and second outlet. A portion of a fluid flow is passed through a first portion of heat exchanger and cooled to a first temperature, while the remainder of a fluid flow undergoes a flow reversal and passes through both portions of the same heat exchanger, thereby cooling it to a second lower temperature. This preferred method enables a single conventional evaporator coil, which is uniformly distributed through the cross-sectional area of the heat exchanger, to generate two fluid flows having different-temperatures.

It should be understood that the preferred embodiment of the invention has been shown and described herein, and that various modifications of the preferred embodiment will become apparent to those skilled in the art after a study of the specification, drawings and the followings claims.

What is claimed is:

1. A refrigerated cooler for containing a product, comprising:

a cabinet having a partition defining a heat transfer chamber and a thermally insulated product storage chamber having an access opening providing fluid communication between said product storage chamber and ambient air;

powered means mounted near an inlet opening defined by said partition for moving air to create a primary fluid flow from said product storage chamber into said heat transfer chamber;

a heat exchanger disposed in said heat transfer chamber;

direction controlling means for directing said primary fluid flow toward and through a first portion of said heat exchanger, thereby cooling said primary fluid flow to a first temperature, said direction controlling means adapted to split said primary fluid flow into first and second subsidiary fluid flows, and to direct said first subsidiary fluid flow through a first outlet defined by said partition into said product storage chamber, and to direct said second subsidiary fluid flow through a second portion of said heat exchanger, thereby cooling said second subsidiary fluid flow to a second temperature, said direction controlling means adapted to direct said second subsidiary fluid flow through a second outlet defined by said partition into said product storage chamber;

baffle means in said heat transfer chamber for maintaining said primary fluid flow and said second subsidiary fluid flow separate; and flow means for directing said second subsidiary fluid flow in an air curtain across said access opening;

wherein said first temperature is greater than said second temperature, thereby more evenly cooling said chamber.

2. The heat transfer device as claimed in claim 1, wherein the position of said baffle means defines a proportional relationship between respective sizes of said first and second portions of said heat exchanger, thereby defining proportional flow rates between said first and second subsidiary fluid flows.

3. The cooler as claimed in claim 1, wherein said product has a freezing temperature, said cabinet adapted to maintain said product at a temperature proximate to and greater than said freezing temperature.

4. The cooler as claimed in claim 1, wherein said cooler further comprises elevating means for supporting said product and thereby forming a channel between a bottom of said product and a floor of said cooler for facilitating passage of said first subsidiary fluid flow.

5. A refrigerated cooler for containing a product, comprising:

a cabinet having a partition defining a heat transfer chamber and a thermally insulated product storage chamber having an access opening disposed at an upper front portion of said cabinet;

powered means mounted near an inlet opening defined by said partition at an upper rear portion of said storage chamber for moving a fluid to create a primary fluid flow from said product storage chamber into said heat transfer chamber;

a heat exchanger disposed in said heat transfer chamber;

direction controlling means for directing said primary fluid flow toward and through a first portion of said heat exchanger, thereby cooling said primary fluid flow to a first temperature, said direction controlling means adapted to split said primary fluid flow into first and second subsidiary fluid flows, and to direct said first subsidiary fluid flow through a first outlet defined by said partition proximate to a floor of said chamber into said product storage chamber, and to direct said second subsidiary fluid flow through a second portion of said heat exchanger, thereby cooling said second subsidiary fluid flow to a second temperature, said direction controlling means adapted to direct said second subsidiary fluid flow through a second outlet defined by said partition along an edge of said access opening into said product storage chamber; and baffle means in said heat transfer chamber for maintaining said primary fluid flow and said second subsidiary fluid flow separate;

wherein said first temperature is greater than said second temperature, thereby more evenly cooling said chamber.

6. A storage unit for storing a product comprising:

a cabinet having a partition to define a heat transfer chamber and a product storage chamber and an opening, said partition having an inlet and a first and second outlet formed therein to provide fluid communication between said heat transfer chamber and said product storage chamber;

powered means for creating a primary fluid flow of a fluid from said product storage chamber through said inlet and into said heat transfer chamber; and a heat transfer device disposed within said heat transfer chamber including:

a heat exchanger;

direction controlling means for directing said primary fluid flow across a first portion of said heat exchanger to affect a first temperature change of said primary fluid flow, for splitting said primary fluid flow into first and second subsidiary fluid flows such that said first subsidiary fluid flow is discharged through said first outlet into said product storage chamber, for directing said second subsidiary fluid flow across a second portion of said heat exchanger to affect a second temperature change of said second subsidiary fluid flow, and for discharging said second subsidiary fluid flow through said second outlet into said product storage chamber across said opening as a curtain of fluid; and a baffle located between said inlet and said second outlet.

7. The storage unit as claimed in claim 6 wherein said second subsidiary fluid flow flows through said second portion of said heat exchanger in a direction opposite said primary fluid flow over said first portion of said heat exchanger.

8. The storage unit as claimed in claim 6 wherein said baffle defines a proportional size of said first and second portions of said heat exchanger, thereby defining proportional flow rates between said first and second subsidiary fluid flows.

9. The storage unit as claimed in claim 6 wherein said first outlet is disposed proximate to a floor of said cabinet.

10. The storage unit as claimed in claim 6 wherein said opening is disposed at an upper front portion of said cabinet; said inlet is disposed at an upper rear portion of said product storage chamber; said first outlet is disposed proximate to a floor of said product storage chamber; and said second outlet is disposed along an edge of said opening.

11. The storage unit as claimed in claim 10 wherein said cabinet further comprises means for supporting the product above said floor thereby facilitating passage of said first subsidiary flow from said heat transfer chamber into said product storage chamber.

12. The heat transfer device as claimed in claim 6, wherein said heat transfer device is adapted to cool said primary and said second subsidiary fluid flows, said second temperature being lower than said first temperature.

13. The heat transfer device as claimed in claim 12, wherein said heat transfer device is adapted to contain a product having a freezing temperature, said first temperature being greater than said freezing temperature, said second temperature being lower than said freezing temperature, so that said product is maintained at a range of temperatures proximate to said freezing temperature without freezing said product, during normal operation of said heat transfer device.

14. The heat transfer device as claimed in claim 13, wherein said product is maintained at a range of temperatures less than 40° F. without freezing said product.

15. The heat transfer device as claimed in claim 6, wherein said heat exchanger is adapted to heat said primary and second subsidiary fluid flows, said second temperature being greater than said first temperature.

16. The heat transfer device as claimed in claim 6, wherein said fluid is air.

* * * * *